US006488220B2

(12) United States Patent
Girlinger et al.

(10) Patent No.: US 6,488,220 B2
(45) Date of Patent: Dec. 3, 2002

(54) FUEL INJECTION VALVE FOR INTERNAL COMBUSTION ENGINES

(75) Inventors: Gerhard Girlinger, Leonding (AT); Manfred Hackl, Linz (AT); Stefan Reisinger, Haibach (AT)

(73) Assignee: Robert Bosch GmbH, Stuttgart (DE)

( * ) Notice: Subject to any disclaimer, the term of this patent is extended or adjusted under 35 U.S.C. 154(b) by 41 days.

(21) Appl. No.: 09/825,042

(22) Filed: Apr. 4, 2001

(65) Prior Publication Data

US 2001/0054653 A1 Dec. 27, 2001

(30) Foreign Application Priority Data

Apr. 8, 2000 (DE) ..... 100 17 657

(51) Int. Cl.[7] ..... B05B 1/30; F02M 51/00

(52) U.S. Cl. ..... 239/585.1; 239/88; 239/91; 239/93; 239/95; 239/96

(58) Field of Search ..... 239/88, 91, 93, 239/95, 96, 585.1

(56) References Cited

U.S. PATENT DOCUMENTS 5,265,804 A * 11/1993 Brunel ..... 239/585.1
5,865,373 A * 2/1999 Buckley et al. ..... 239/88
6,027,037 A * 2/2000 Murakami et al. ..... 239/88
6,168,087 B1 * 1/2001 Cooke ..... 239/88
6,260,768 B1 * 7/2001 Timms ..... 239/585.1
6,267,306 B1 * 7/2001 Phillips et al. ..... 239/585.1

* cited by examiner

*Primary Examiner*—Robin O. Evans
(74) *Attorney, Agent, or Firm*—Ronald E. Greigg

(57) ABSTRACT

The fuel injection valve is in particular a component of a reservoir fuel injection system and has a valve body and an electric control valve that controls the pressure which prevails in a control pressure chamber and acts at least indirectly on an injection valve member in its closing direction, wherein the control pressure chamber is connected to a high-pressure fuel source and can be connected by the control valve to a discharge chamber in order to open at least one injection opening. The control pressure chamber is embodied in a sleeve-shaped section of an insert piece inserted into the valve body and is connected to an inlet bore in the valve body by means of an annular chamber encompassing the section and a connecting bore provided in the valve body. The connecting bore intersects the inlet bore at an obtuse angle ($\alpha$) in a region that is offset from the annular chamber in the direction of the longitudinal axis of the valve body.

8 Claims, 2 Drawing Sheets

FUEL INJECTION VALVE FOR INTERNAL COMBUSTION ENGINES

BACKGROUND OF THE INVENTION

1. Field of the Invention

The invention is based on a fuel injection valve for internal combustion engines particularly as a component of a reservoir fuel injection system.

2. Description of the Prior Art

A fuel injection valve of the type with which this invention is concerned is known from the literature, see the document Dieselmotorentechnik 2000 [Diesel Motor Engineering 2000], Expert Verlag 1999, p. 222. This fuel injection valve is a component of a reservoir fuel injection system. The fuel injection valve has a valve body and an injection valve member guided so that it can move axially, which controls at least one injection opening. The injection valve member has a pressure shoulder that defines a pressure chamber; the pressure chamber is supplied with pressurized fuel from a high-pressure fuel source as a result of which the injection valve member can be lifted up from a valve seat counter to a closing force in order to open the at least one injection opening. The fuel injection valve has an electric control valve which influences the movement of the injection valve member by controlling the pressure which prevails in a control pressure chamber connected to the high-pressure fuel source and acts on the injection valve member at least indirectly in its closing direction; the control valve can connect the control pressure chamber to a discharge chamber. Inside a sleeve-shaped section of an insert piece inserted into the valve body, the control pressure chamber is defined by a section of the injection valve member or an intermediary member that acts on it. An annular chamber is formed between the valve body and the sleeve-shaped section of the insert piece. The insert piece has a flange with which it contacts the valve body toward the annular chamber, in the direction of the longitudinal axis of the valve body. The control pressure chamber in the sleeve-shaped section of the insert piece communicates with the annular chamber via at least one opening in the insert piece. An inlet bore is provided in the valve body and this bore extends at least essentially in the longitudinal direction of the valve body and connects the pressure chamber to a connection of the high-pressure fuel source that is provided on the fuel injection valve. The annular chamber is connected to the inlet bore by means of a connecting bore provided in the valve body. The connecting bore extends approximately at right angles to or inclined at an acute angle to the inlet bore and connects to the circumferential surface of the annular chamber. The connecting bore intersects the inlet bore in a region disposed at the level of the annular chamber. At the intersection of the connecting bore and the inlet bore, very high mechanical stresses occur in the valve body, induced by the high pressure prevailing in the annular chamber and the bores and by the bracing of the insert piece to the valve body. In order to achieve a sufficient service life of the valve body, the fuel pressure must be limited and/or an expensive, high-strength material must be used. In order to comply with current and future emissions limits, however, the goal is to increase fuel pressure further.

OBJECT AND SUMMARY OF THE INVENTION

The fuel injection valve according to the invention has the advantage over the prior art that the mechanical stresses in the valve body at the intersection of the connecting bore and the inlet bore are reduced and as a result, the fuel pressure can be increased and/or less expensive, lower-strength materials can be used and a sufficient service life of the valve body is nevertheless assured.

One embodiment of the fuel injection valve according to the invention permits a level disposition of the connecting bore with a slight inclination in relation to the inlet bore.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
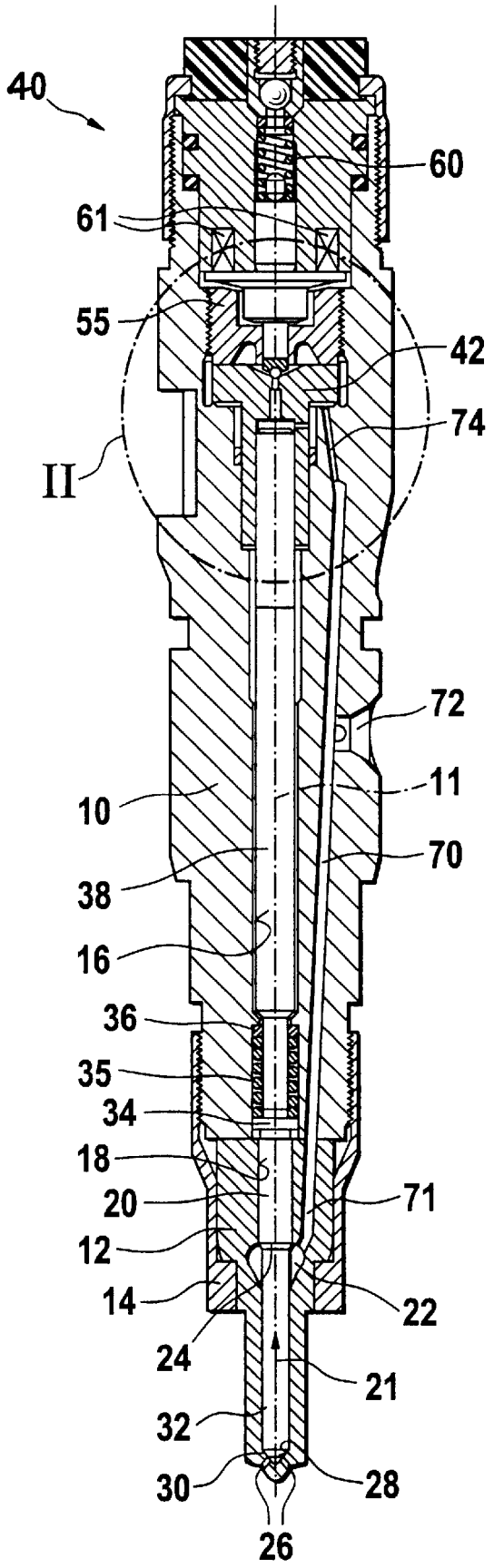
FIG. 1 is a longitudinal section through a fuel injection valve according to the invention.
Figure 2:
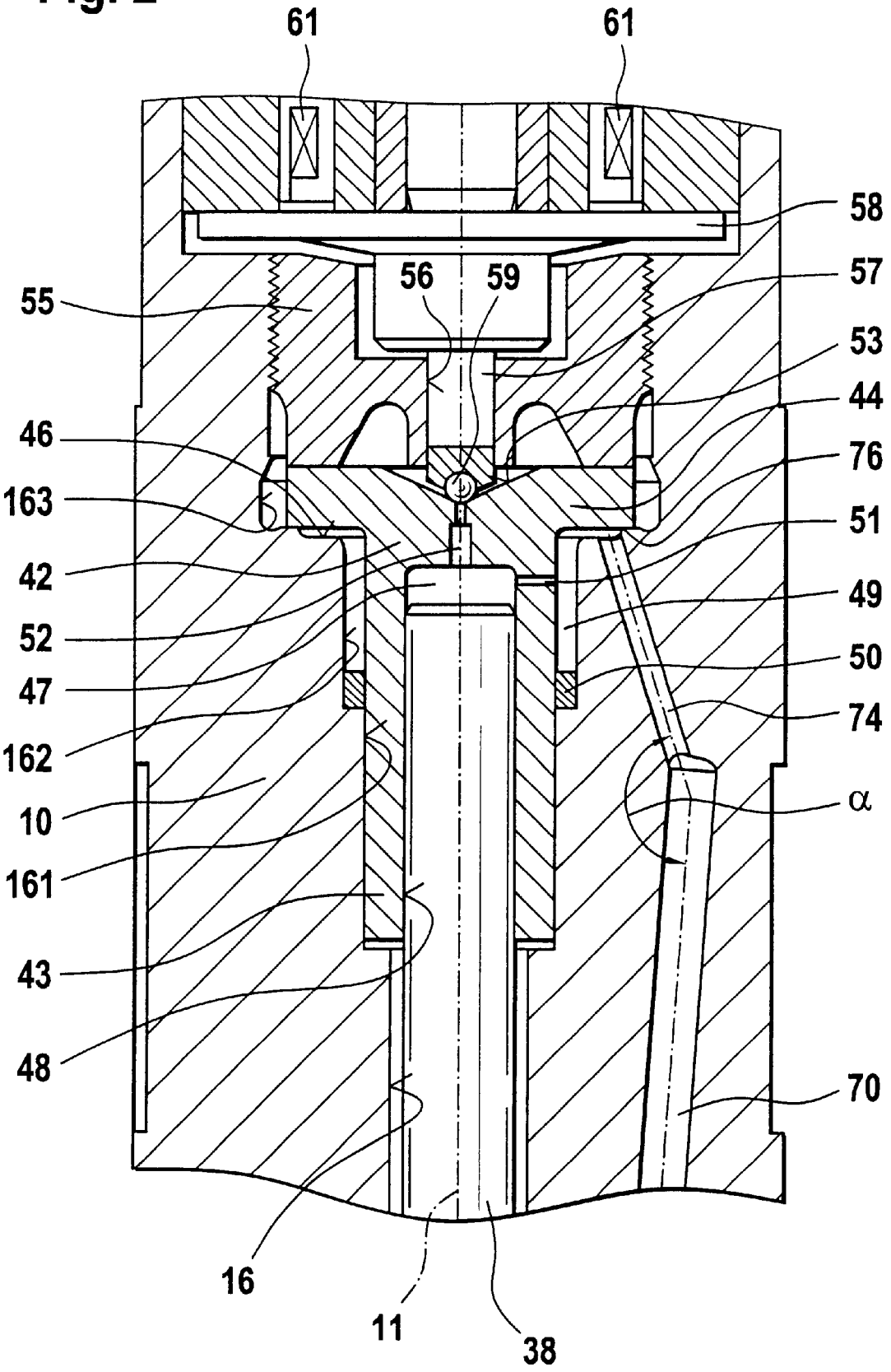
FIG. 2 is an enlarged detail of the fuel injection valve, which is labeled II in FIG. 1.

FIGS. 1 and 2 show a fuel injection valve for internal combustion engines, preferably compression-ignition engines, which valve is in particular a component of a reservoir fuel injection system. The reservoir fuel injection system has a high-pressure pump which supplies fuel to a reservoir in the form of a rail from which lines lead to fuel injection valves disposed at the cylinders of the internal combustion engine. The reservoir thus constitutes a high-pressure fuel source which is connected to the fuel injection valve.

The fuel injection valve has an approximately cylindrical valve body 10 which is preferably made of steel. A valve housing part 12 is braced against the valve body 10 at one end by means of a clamping nut 14; the valve housing part 12 and the clamping nut 14 are preferably also made of steel. A bore 16 extending at least approximately coaxial to the longitudinal axis 11 of the valve body is embodied in the valve body 10 and a bore 18 extending at least approximately coaxial to the bore 16 is embodied in the valve housing part 12; the diameter of the bore 18 is smaller than that of the bore 16 in the valve body 10. A piston-shaped injection valve member 20 is disposed so that it can move axially in the bore 18 of the valve housing part 12. The bore 18 in the valve housing part 12 has a radial widening which constitutes a pressure chamber 22. The injection valve member 20 is embodied with a stepped diameter and transitions into a smaller diameter in the vicinity of the pressure chamber 22, as a result of which a pressure shoulder 24 is formed on the injection valve member 20 in the pressure chamber 22. In its end region oriented toward the combustion chamber of the cylinder of the internal combustion engine, the valve housing part 12 has at least one, preferably several injection openings 26. In its end region oriented toward the combustion chamber, the injection valve member 20 has a for example approximately conical sealing surface 28 which cooperates with a valve seat 30 embodied in the valve housing part 12. An annular chamber 32 is formed in the valve housing part 12, between the injection valve member 20 and the section of the bore 18 that starts from the pressure chamber 22 and is oriented toward the combustion chamber; this annular chamber 32 is in turn connected to the reservoir as a high-pressure fuel source, as will be explained in more detail below. The pressure prevailing in the pressure chamber 22 exerts a force acting in the opening direction 21 on the injection valve member 20 via its pressure shoulder 24. In its larger diameter end region remote from the combustion chamber, the injection valve member 20 is guided in a sealed fashion in the valve housing part 12, in the section of the bore 18 that starts from the pressure chamber 22 and is oriented away from the combustion chamber.

The end of the injection valve member 20 remote from the combustion chamber protrudes into the bore 16 of the valve body 10, which bore, in its end section oriented toward the valve housing part 12, has a larger diameter than the bore 18 in the valve housing part 12. At the end of the valve member 20 protruding into the bore 16, there is a spring plate 34 which can be embodied of one piece with the valve member 20 or can be connected to it as a separate part. A prestressed compression spring 35 is disposed in the end section of the bore 16, supported at one end against the spring plate 34 and at the other end against an annular shoulder 36 formed by a transition of the bore 16 into a section with a smaller diameter. The compression spring 35 acts on the injection valve member 20 in its closing direction and presses it with its sealing surface 28 against the valve seat 30.

A push rod 38 is movably guided in the bore 16 of the valve body 10 and with its end oriented toward the combustion chamber, passes through the compression spring 35 and rests with its butt end against the spring plate 34. The bore 16 of the valve body 10 increases in diameter in a number of steps toward the end of the valve body 10 remote from the combustion chamber. At the end of the valve body 10 remote from the combustion chamber, it has an electrically controlled valve 40 incorporated into it, which can be a solenoid valve or a piezoelectric valve.

From the end remote from the combustion chamber, the valve body 10 has an insert piece 42 inserted into it, which is preferably made of steel and has a sleeve-shaped section 43 that is disposed in a bore section 161 of the valve body 10. The sleeve-shaped section 43 can be press-fitted into the bore section 161. The insert piece 42 also has a flange 44, which has a larger diameter than the sleeve-shaped section 43 and is disposed in a bore section 163 that has a correspondingly larger diameter. The flange 44 is disposed with radial play in the bore section 163. Between the bore sections 161 and 163, there is another bore section 162 whose diameter is somewhat larger than the diameter of the bore section 161, but is smaller than the diameter of the bore section 163. An annular shoulder 46 that faces away from the combustion chamber is formed onto the valve body 10 at the transition between the bore sections 162 and 163. The sleeve-shaped section 43 of the insert piece 42 has a bore 48 which extends at least approximately coaxial to the bore 16 of the valve body 10; the end region of the push rod 38 remote from the combustion chamber is disposed so that it can move inside this bore 48. The push rod 38 defines a control pressure chamber 47 in the bore 48 of the sleeve-shaped section 43 of the insert piece 42.

An annular chamber 49 is formed between the bore section 162 and the outer circumference of the sleeve-shaped section 43 of the insert piece 42. A sealing ring 50 which encompasses the sleeve-shaped section 43 is disposed in the annular chamber 49, at the transition to the bore section 161. The sleeve-shaped section 43 of the insert piece 42 has at least one opening 51 which connects the control pressure chamber 47 to the annular chamber 49. From the control pressure chamber 47 in the sleeve-shaped section 43 of the insert piece 42, a significantly smaller diameter bore 52 leads through the flange 44; the diameter of this bore decreases further toward the side remote from the section 43 and then widens out to its mouth on the flange 44, for example with an approximately conical oblique surface 53. A securing element 55 preferably made of steel is inserted, preferably screwed, into the bore section 163, on the side of the flange 44 of the insert piece 42 remote from the combustion chamber; the bore section 163 has an internal thread in its end region remote from the flange 44 and the securing element 55 has an external thread. The securing element 55 engages the flange 44 and presses it against the annular shoulder 46 of the valve body 10.

The securing element 55 has a bore 56 which is disposed at least approximately coaxial to the bores 48, 52 of the insert piece 42 and an armature bolt 57 of a magnet armature of the solenoid valve 40 passes through this bore 56. The magnet armature also has an armature plate 58, which has a greater diameter than the armature bolt 57 and is disposed at the opposite end of the magnet armature from the insert piece 42. A closing member in the form of a ball 59 is attached to the butt end of the armature bolt 57 oriented toward the insert piece 42 and cooperates with the mouth of the bore 52 and the oblique surface 53 on the flange 44 of the insert piece 42 that functions as a valve seat. The magnet armature is pressed with the ball 59 against the valve seat 53 by means of a prestressed compression spring 60. The solenoid valve 40 also has an electromagnet 61 which when supplied with current, generates a magnetic field which attracts the armature plate 58 of the magnet armature counter to the force of the compression spring 60 so that the ball 59 lifts up from the valve seat 53 and unblocks the opening 52 thereby connecting the control pressure chamber 47 to a discharge chamber.

An inlet bore 70 is provided in the valve body 10, which extends at least essentially in the direction of the longitudinal axis of the valve body 10. The inlet bore 70 of the valve body 10 continues in an inlet bore 71, which is provided in the valve housing part 12 and feeds into the pressure chamber 22. The inlet bore 70 of the valve body 10 communicates with a connection 72 fed by the line which leads from the reservoir to the fuel injection valve and delivers high-pressure fuel. In FIG. 1, the connection 72 is shown offset into the plane of the drawing and is actually disposed offset in the circumferential direction toward the inlet bore 70 and is connected to the inlet bore 70 via a short branch bore extending approximately tangential to the longitudinal axis 11 of the valve body 10. A connecting bore 74 in the valve body 10 leads from the inlet bore 70 and connects the control pressure chamber 47 to the high-pressure fuel source in the form of the reservoir.

As shown in FIG. 2, the annular shoulder 46 of the valve body 10 has a raised annular rib 76 embodied on it which is contacted by the flange 44 of the insert piece 42 in the direction of the longitudinal axis 11 of the valve body 10. Radially inside the annular rib 76, the annular shoulder 46 is consequently embodied as recessed so that an axial gap that communicates with the annular chamber 49 remains between the annular shoulder 46 and the flange 44 of the insert piece 42.

The connecting bore 74 has a smaller diameter than the inlet bore 70. As shown in FIG. 1, the inlet bore 70 extends away from the combustion chamber inclined in relation to the longitudinal axis 11 of the valve body 10 in such a way that the inlet bore 70 approaches the outer circumference of the valve body 10. In terms of the direction of the longitudinal axis 11 of the valve body 10, the connecting bore 74 intersects the inlet bore 70 at the level of the bore section 161 and thereby offset from the bore section 162 in which the annular chamber 49 is embodied. The connecting bore 74 extends at an inclination opposite from that of the inlet bore 70, i.e. leading away from the combustion chamber, the connecting bore 74 extends inclined in relation to the longitudinal axis 11 of the valve body 10 in such a way that it diverges from the outer circumference of the valve body 10. The connecting bore 74 consequently intersects the inlet bore 70 at an obtuse angle α. For example, the angle α is between 1200° and 1600°. The connecting bore 74 connects to the annular shoulder 46 of the valve body 10 inside the annular rib 76. The control pressure chamber 47 is consequently connected to the inlet bore 70 via the opening 51, the annular chamber 49, the axial gap between the flange 44 and the annular shoulder 46, and the connecting bore 74 and is therefore connected to the reservoir as a high-pressure fuel source. The transition from the inlet bore 70 to the connecting bore 74 is preferably deburred and rounded, which can be easily achieved from the inlet bore 70 with a mechanical tool.

The high pressure produced by the high-pressure fuel source prevails in the annular chamber 49 and causes a high mechanical stress on the valve body 10 in the vicinity of the bore section 162. Furthermore, the valve body 10 is also loaded by means of the initial stress with which the insert piece 42 is pressed by the securing element 55 against the annular rib 76 on the annular shoulder 46. High pressure does not prevail in the vicinity of the bore section 161 because the bore section 161 is isolated from the annular chamber 49 by the sleeve-shaped section 43 of the insert piece 42 and the sealing ring 50. Consequently, high pressure does not prevail in the vicinity in which the intersection of the connecting bore 74 and the inlet bore 70 is disposed, and the mechanical stress of the valve body 10 is less than in the vicinity of the annular chamber 49.

The function of the fuel injection valve according to the invention will be explained below. If the fuel injection valve should be kept closed, then the control valve 40 is without current so that the compression spring 60 presses the ball 59 against the valve seat 53 and the control pressure chamber 47 is isolated from the discharge chamber. The high pressure produced by the high-pressure fuel source prevails in the control pressure chamber 47 and acts on the push rod 38 which in turn, via the spring plate 34, acts on the injection valve member 20 in its closing direction. The force exerted on the injection valve member 20 in the closing direction by the push rod 38 and the compression spring 35 is greater than the force exerted by the high-pressure fuel in the opening direction 21 on the injection valve member 20 by means of its pressure shoulder 24 so that the injection openings 26 are closed and no fuel is injected into the combustion chamber.

In order to open the fuel injection valve, the control valve 40 is supplied with current which causes its electromagnet 61 to attract the armature plate 58 of the magnet armature and the ball 59 lifts up from the valve seat 53 and unblocks the bore 52. Consequently, the control pressure chamber 47 is connected to the discharge chamber which can, for example, be a fuel tank, and fuel can flow out of the control pressure chamber 47 into the discharge chamber. The small diameter bore 52 produces a throttling so that the fuel quantity flowing out of the control pressure chamber 47 remains low. Through the connection of the control pressure chamber 47 to the discharge chamber, the pressure in the control pressure chamber 47 drops below the high pressure produced by the high-pressure fuel source. The high pressure supplied by the high-pressure fuel source acts on the pressure shoulder 24 of the injection valve member 20 and produces a force acting on the injection valve member 20 in its opening direction 21 that is greater than the sum of the force exerted by the compression spring 35 and the force exerted by means of the push rod 38 by the pressure prevailing in the control pressure chamber 47 so that the injection valve member 20 is moved in the opening direction 21. The fuel is thereby injected into the combustion chamber by means of the injection openings 26. In order to close the fuel injection valve, the control valve 40 is once again switched to the currentless state so that the control pressure chamber 47 is isolated from the discharge chamber and the pressure in the control pressure chamber 47 increases to the high pressure supplied by the high-pressure fuel source and moves the injection valve member 20 in the closing direction by means of the push rod 38.

The foregoing relates to preferred exemplary embodiments of the invention, it being understood that other variants and embodiments thereof are possible within the spirit and scope of the invention, the latter being defined by the appended claims.

We claim:

1. In a fuel injection valve for internal combustion engines, particularly as a component of a reservoir fuel injection system, having a valve body (10), having an injection valve member (20) that is guided so that it can move axially, controls at least one injection opening (26), and has a pressure shoulder (24) that defines a pressure chamber (22), wherein the pressure chamber (22) is supplied with pressurized fuel by a high-pressure fuel source by means of which the injection valve member (20) can be lifted up from a valve seat (30) counter to a closing force in order to open the at least one injection opening (26), having an electric control valve (40) that influences the movement of the injection valve member (20) and controls the pressure prevailing in a control pressure chamber (47) and acting at least indirectly on the injection valve member (20) in its closing direction, wherein the control pressure chamber (47) is connected to the high-pressure fuel source and can be connected by the control valve (40) to a discharge chamber in order to open the at least one injection opening (26), wherein the control pressure chamber (47) is defined in a sleeve-shaped section (43) of an insert piece (42) inserted into the valve body (10), by an intermediary member (38) acting on the injection valve member (20), wherein an annular chamber (49) is formed between the sleeve-shaped section (43) of the insert piece (42) and the valve body (10), wherein the insert piece (42) has a flange (44) with which it contacts the valve body (10) in the direction of the longitudinal axis (11) of the valve body (10), wherein the control pressure chamber (47) communicates with the annular chamber (49) via at least one opening (51) in the insert piece (42), wherein an inlet bore (70) is provided in the valve body (10), which bore extends at least essentially along the longitudinal direction (11) of the valve body (10) and connects the pressure chamber (22) to a connection (72) of the high-pressure fuel source that is provided on the fuel injection valve, and wherein the annular chamber (49) is connected to the inlet bore (70) by means of a connecting bore (74) provided in the valve body (10), the improvement wherein the connecting bore (74) intersects the inlet bore (70) at an obtuse angle (α) in a region that is offset from the annular chamber (49) in the direction of the longitudinal axis (11) of the valve body (10).

2. The fuel injection valve according to claim 1, wherein the valve body (10) has a bore (16) with a bore section (163) containing the flange (44) of the insert piece (42) and with a smaller diameter bore section (162) containing the annular chamber (49) and the sleeve-shaped section (43) of the insert piece (42), in that at the transition between the bore sections (162, 163), an annular shoulder (46) is formed, which faces in the direction of the longitudinal axis (11) of the valve body (10) and on which a raised annular rib (76) is disposed, which is contacted by the flange (44) of the insert piece (42), and in that the connecting bore (74) connects to the annular shoulder (46) inside the annular rib (76) and communicates with the annular chamber (49) via an axial gap between the flange (44) and the annular shoulder (46).

3. The fuel injection valve according to claim 1, wherein the connecting bore (74) has a smaller diameter than the inlet bore (70).

4. The fuel injection valve according to claim 1, wherein the transition from the inlet bore (70) into the connecting bore (74) is rounded.

5. The fuel injection valve according to claim 2, wherein the connecting bore (74) has a smaller diameter than the inlet bore (70).

6. The fuel injection valve according to claim 2, wherein the transition from the inlet bore (70) into the connecting bore (74) is rounded.

7. The fuel injection valve according to claim 3, wherein the transition from the inlet bore (70) into the connecting bore (74) is rounded.

8. The fuel injection valve according to claim 5, wherein the transition from the inlet bore (70) into the connecting bore (74) is rounded.

* * * * *